United States Patent [19]

Küpper

[11] Patent Number: 4,668,851

[45] Date of Patent: May 26, 1987

[54] CIRCUITRY FOR CONTROL OF THE TEMPERATURE OF A HEATING ELEMENT ADAPTED TO BE CONTACTED BY A MATERIAL TO BE HEATED

[75] Inventor: Anton Küpper, St. Paul, Minn.

[73] Assignee: Minnesota Mining and Manufacturing Company, St. Paul, Minn.

[21] Appl. No.: 773,436

[22] Filed: Sep. 6, 1985

[51] Int. Cl.[4] ..... H05B 6/06

[52] U.S. Cl. ..... 219/10.77; 219/10.61 R; 219/10.49 R; 219/503

[58] Field of Search ..... 219/10.77, 10.75, 10.61 R, 219/10.49 R, 503, 510; 323/262

[56] References Cited

U.S. PATENT DOCUMENTS

| | | | |
|---|---|---|---|
| 2,349,569 | 5/1944 | Wilson | 219/10.61 R |
| 3,686,460 | 8/1972 | Lamparter et al. | 219/10.77 |
| 3,743,808 | 7/1973 | Kasper | 219/10.77 X |
| 4,112,286 | 9/1978 | Alderman et al. | 219/10.77 X |
| 4,317,979 | 3/1982 | Frank et al. | 219/10.77 |
| 4,350,861 | 9/1982 | Pouillange et al. | 219/10.61 R |
| 4,356,371 | 10/1982 | Kiuchi et al. | 219/10.77 |

FOREIGN PATENT DOCUMENTS

| | | | |
|---|---|---|---|
| 58-35568 | 3/1983 | Japan | 219/10.61 R |

*Primary Examiner*—Philip H. Leung

*Attorney, Agent, or Firm*—Donald M. Sell; James A. Smith; Robert L. Marben

[57] ABSTRACT

A circuit arrangement for control of the temperature of a heating element adapted for contact by a material to be heated includes a transformer wherein the secondary winding is a metal ring which is the heating element with a temperature detection winding provided on the core of the transformer. An electronic switch and current sensing means are connected to the primary. A comparator, which receives input signals from the current sensing means and temperature detection winding, is operatively connected to the electronic switch to control its operation.

7 Claims, 2 Drawing Figures

CIRCUITRY FOR CONTROL OF THE TEMPERATURE OF A HEATING ELEMENT ADAPTED TO BE CONTACTED BY A MATERIAL TO BE HEATED

TECHNICAL FIELD

The present invention relates to circuitry for heating a heating element for transferring heat to a material and for determining whether the temperature of the heating element is below a desired temperature and, in particular, to such circuitry wherein the heating element is the secondary winding of a transformer.

Specifically, the present invention relates to circuitry for heating a material in tape form. For example, a heating treatment of this kind is required for the development of film material in tape or strip form.

BACKGROUND ART

A number of devices are known for heating elements and materials. For example, one known design includes an ohmic heating element mounted for rotation and comprising slip rings for supplying the power required for heating; the material in tape form to be heated is wrapped around the heating element. The temperature is sensed by means such as a temperature sensor firmly coupled with the element to be heated, with the test voltage transmitted through additional slip ring assemblies. One disadvantage of apparatus of this kind is that the slip rings give rise to retarding torques, transfer resistances and thermo voltages. Also, the slip rings are subject to wear. The temperature sensor is coupled firmly with the element to be heated and detects the temperature only at the point where it is located. In addition, the time constant of the sensor reduces the response rate of the arrangement in its entirety.

Also, it has been known to couple temperature sensors to a heating element by a non-stationary or sliding type of engagement. Arrangement of this nature are disadvantageous in that the sensor detects only the temperature prevailing at its instantaneous location. Also, the thermal transfer resistance between the sensor and the test object is difficult to predict, with fluctuations in thermal coupling causing undesirable temperature drift. In addition, this arrangement of the temperature sensor causes its time constant to vary so that the rate of response of the control loop will be decreased accordingly.

Further, it has been known to determine the temperature of test objects by radiation measurement. This technique is advantageous in that it operates by means of a pyrometer and does not rely on physical contact between the sensor and the test object. As in the prior teachings discussed above, the temperature value it yields relates only to the partial area of the test object which is sensed by the pyrometer at any one time. Also, the radiation emitted by the test object and received by the pyrometer is affected rather strongly by the nature of the surface of the test object, resulting in test errors in case the surface undergoes changes in the course of the measuring procedure.

SUMMARY OF THE INVENTION

It is an object of the present invention to provide a circuit arrangement for heating a heating element adapted to be contacted by a material and for detecting a first electrical parameter relating to the temperature of the heating element to enable power to be supplied to the heating element in accordance with a comparison made in a simple manner of the detected first electrical parameter relative to a second electrical parameter, with the first electrical parameter detection not relating to any specific location of the heating element.

An essential advantage of the present invention is that neither the supply of power to the heating element, nor the detection of the electrical parameter relating to the temperature of the heating element, nor the transmission of such electrical parameter to a comparator require moving parts.

Another advantage of the present invention is that the temperature control loop provided by the present invention includes no delays dependent on temperature conduction, which would prevent rapid response and/or cause temperature overshoot in the case of rapid departures from the steady-state condition. In the present invention, the response rate depends solely on the settling time of the circuitry used for determining whether a change in power to the heating element is required.

Advantageously, the present arrangement is indicative of the mean temperature of the heating element, not the temperature of any specific point on the heating element as would be the case if a temperature responsive sensor were used.

Another essential advantage of the present invention is that the heating element at no time experiences temperatures higher than those actually needed. As a result, the material heated by the heating element is not loaded more highly than is absolutely necessary.

Advantageously, the present arrangement does not include any temperature sensors that are subject to aging. Further, and advantageously, there is no thermal coupling between the heating element and a temperature sensor which can vary to distort the sensings made.

The heating element can take the form of a ring member supported for rotation to heat a material in tape or strip form which is held in frictional contact with the ring member to rotate it as the tape or strip is moved, the driving torque of the ring member advantageously depends on its bearing friction only. Eddy currents will not generate any effective braking torque unless the ring member revolves at very high speeds.

Advantageously, the uniformity of the power supplied and thus, assuming a uniform discharge of heat, the temperature distribution of the ring depend linearly on the accuracy of the ring cross section.

As the use of a heating ring permits the ring mass to be heated to be kept as small as mechanically possible, the power rating of the heating assembly advantageously is low and its warm-up period is short.

BRIEF DESCRIPTION OF THE DRAWINGS

The present invention and its embodiment will now be explained in greater detail under reference to the attached drawings wherein.

DETAILED DESCRIPTION

The present invention has particular utility in the context of duplicating microfilms where the film is exposed in one step and is developed in another step. The mother or master film and the film to be exposed are passed from one reel to another with the aid of rollers driven by an electric motor. For development, it is necessary to heat the exposed film. Heating is accomplished by passing the exposed film 2, in the manner shown in FIG. 1, around the heating ring 1, which preferably comprises an aluminum ring member supported by bearings 13 which can be formed from polytetrafluoroethylene.

Contacting the exposed film 2 with heating ring 1 causes the heat required for development to be transferred to film 2. Heating ring 1 is supported for rotation by the aforesaid bearings 13 and is rotated by the movement of film 2 wrapped around it. For example, heating ring 1 may have a cross sectional area of 150 $mm^2$, a peripheral length of 603 mm and a short circuit resistance of 115 micro-ohms at 20° C. Rotation of heating ring 1 by the movement of film 2 causes the heat to be distributed uniformly despite the non-uniform removal of heat.

Figure 1:
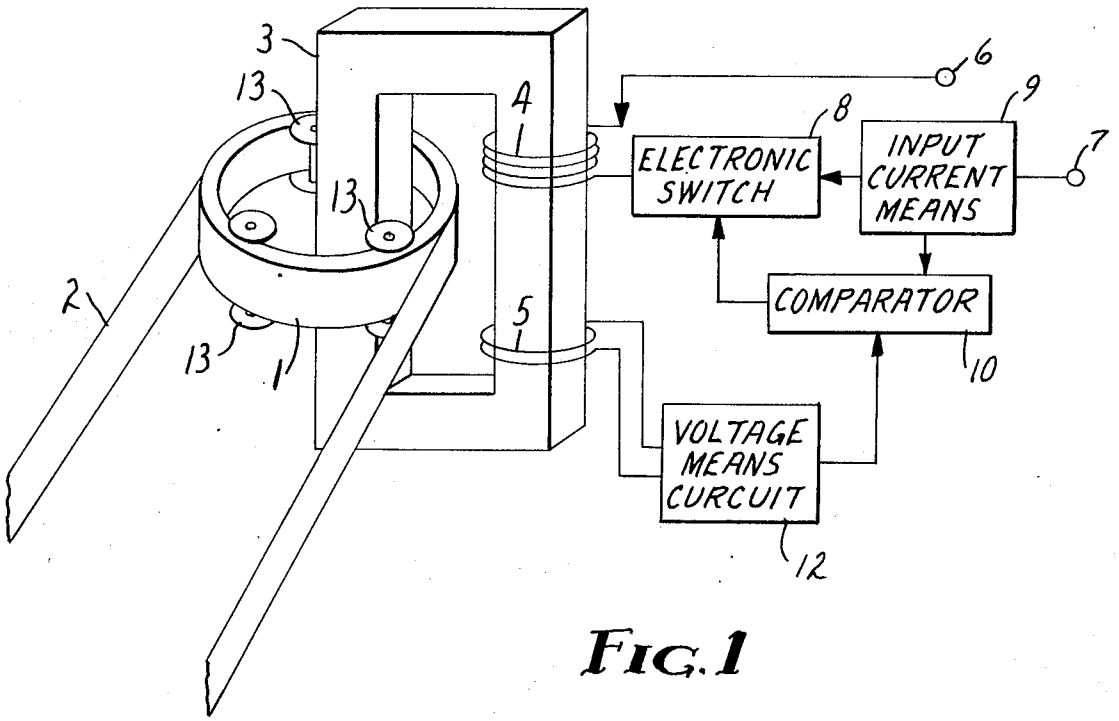
FIG. 1 schematically shows the inventive arrangement.

In the present arrangement, heating ring 1 also constitutes the secondary winding of a transformer, the core of which is shown at 3 in FIG. 1. On its primary side the transformer is coupled through primary winding 1 to terminals 6, 7 of a source of a.c. power. As a result the power required for heating ring 1 is supplied by the aforesaid a.c. power source in the form of an alternating voltage to primary winding 4 and is transferred to heating ring 1 operating as the secondary winding of the transformer, with the supply power being converted to heat in the latter since the secondary winding provides a closed electrical path. For example, the power transferred by the primary winding may be about 1.8 amperes at about 115 volts, with the heating ring 1 flowing a current of 1000 amperes at a voltage of 0.2 volts.

For temperature detection, the present assembly includes an additional winding 5 on core 3 for use as a detection winding to avoid the temperature dependent resistance of the primary winding. A comparison of the current in primary winding 4 with the output voltage of detection winding 5 provides an indication of whether the desired temperature for heating ring 1 is satisfied. The arrangement includes a comparator 10 to compare a signal representative of the output voltage of detection winding 5 with a signal representative of the current in primary winding 4. Preferably, the signal representative of the current in primary winding 4 is generated by the circuit portion 9 detecting the voltage drop across a resistor included in the primary circuit. The difference between the signal representative of the output voltage of detection winding 5 and the signal representative of the current in primary winding 4 is used to control switching means 8 included in the primary circuit for controlling the flow of current in the primary circuit. Preferably, switching means 8 comprises a triac which is controlled by the output of comparator 10.

The following will explain the manner of determining whether the temperature of the heating ring satisfies the desired temperature. In order to heat ring 1 to and hold it at the required temperature, current has to be applied to primary winding 4 from the a.c. source. Also, the temperature of ring 1 cannot be detected unless primary winding 4 receives current, with the output voltage required for temperature measurement (to be detected by voltage measuring circuit portion 12) appearing at detection coil 5. To prevent heating ring 1 from being heated above a predetermined temperature it is necessary to energize primary winding 4 for controlled time periods which on the one hand serve to heat ring 1 to the required temperature and which on the other hand establish the temperature measuring cycle. The current supplied to primary winding 4 is limited by the time period so that ring 1 cannot be heated above the required temperature. Stated in greater detail: The circuit causes an electronic switch 8 connected in circuit with primary winding 4 to be operated for a short period to allow current to flow in primary winding 4. This short ON period would be at least one second. In the following description, this ON period will be referred to as the basic ON period. After the basic ON period has ended, the comparison made by comparator 10 determines whether electronic switch 8 should remain closed so as to heat ring 1 to the required temperature, or whether electronic switch 8 should be opened in case the presence of that temperature has been sensed. In case the temperature of heating ring 1 is below the required value, electronic switch 8 will be maintained in the ON condition until comparator 10 ascertains that the desired temperature has been reached. As a result, the current pulse supplied to primary winding 4 will be extended beyond the basic ON period until ring 1 has the required temperature. Thereafter, electronic switch 8 will be opened and primary winding 4 not be energized until the next basic ON period. If the comparison made during a basic ON period indicates the ring temperature is satisfied, current via electronic switch 8 is terminated after the basic ON period, and a time period (basic OFF period) of five seconds, for example, is provided before the next basic ON period can be provided. The basic OFF period is dependent on the desired control range of the power to be fed to the ring. In the current pulse cycle following an OFF period, the same process takes place which has been described above.

Figure 2:
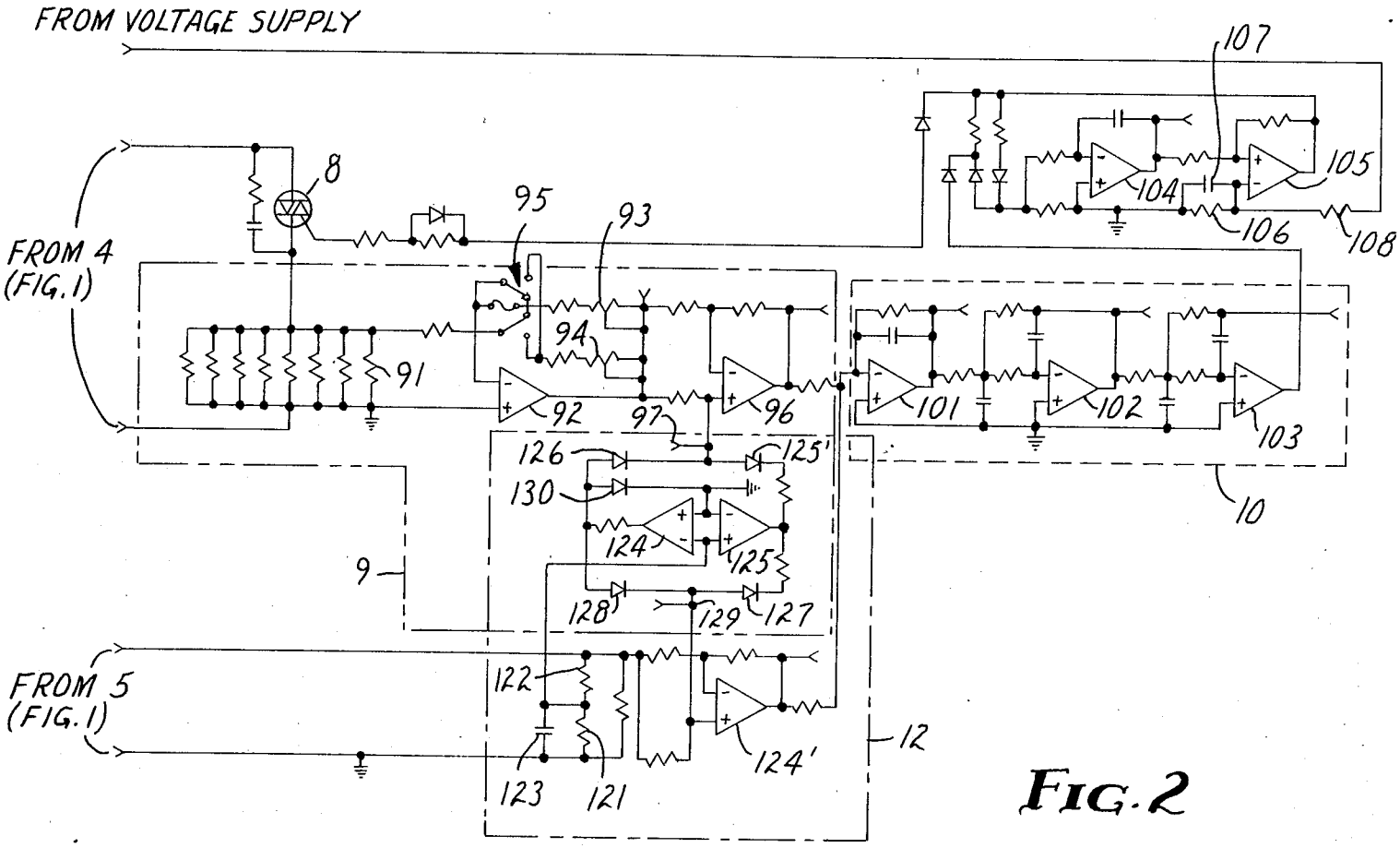
FIG. 2 shows a circuit diagram of the inventive arrangement.

FIG. 2 shows a detailed circuit diagram of the assembly depicted in FIG. 1. Details in FIG. 2 which were described in reference to FIG. 1 have the same reference numerals. One terminal of primary winding 4 is connected to electronic switch 8 and terminal 7 of the primary circuit is connected to current measuring circuit portion 9. The current measuring means comprises at least one resistor 91 connected in series with electronic switch 8 which provides a voltage drop proportional to the current flowing in primary winding 4. The current level is detected by means of an operational amplifier 92 connected to respond to the voltage across resistor 91. The gain of operational amplifier 92 may be varied selectively by means of potentiometer 93 or 94, with potentiometers 93, 94 being connected between the output of amplifier 92 and the input thereof by energizing relay 95. The gain setting depends on the desired temperature of heating ring 1.

Voltage measuring circuit portion 12 receives the detection voltage from detection winding 5. Operational amplifier 124' in voltage measuring circuit portion 12 provides at the output a signal representative of the voltage from winding 5. The gain of amplifier 124' may be adjusted to 1:1 or to 1:−1 by means of two operational amplifiers 124, 125, the inputs of which are coupled in the manner shown, and by means of a diode bridge circuit formed with diodes 125', 126, 127, 128. The outputs of the two amplifiers 124, 125 are connected to the connection common to diodes 126, 128 and to the connection common to diodes 125', 127, respectively. The connections 97, 129 common to diodes 125', 126 and to diodes 127, 128, respectively, provide test points 97, 129. The output of operational amplifier 124 is connected to ground through diode 130. The inverting input of amplifier 124 and the non-inverting input of amplifier 125 are connected together and are coupled to a phase-shifting network 121, 122, 123 to provide a voltage which has its phase shifted relative to the voltage from detection winding 5 by a predetermined angle. The purpose and the operation of this phase shifting network will be explained in greater detail below. Preferably, the phase shifting network comprises resistors 121, 122 connected in series across the terminals of detection winding 5 or between the inputs of voltage measuring means 12, and a capacitor 123 connected in parallel with resistor 121. The remaining inputs of amplifiers 124, 125 are connected together and are coupled to ground. With the inputs connected in this manner, the outputs of operational amplifiers 124, 125 are oppositely polarized at any time. To start with, it may be assumed that the output of amplifier 124 has a negative potential thereat during a half-period of the phase-shifted detection winding voltage; the output of amplifier 125 will thus be positive. In this case, all of diodes 125' to 128 are reverse biased so that test point 129 has no potential and amplifier 124' has a gain of 1:1. The same applies to operational amplifier 96, to which is supplied the signal representative of the current in the primary circuit. One input of amplifier 96 is coupled via a resistor to the output of amplifier 92, which provides the aforesaid signal, and is also connected to test point 97 of the diode bridge. Reversing the polarities of the outputs of amplifiers 124, 125 will cause current to flow through diodes 127, 128, 130 and through the resistors in series with them. Test point 129 has ground potential now, which causes amplifier 124' to have a gain of 1:−1. Similar conditions exist for diodes 125', 126, 130, for test point 97 and for amplifier 96, meaning that amplifiers 96, 124' act as phase-sensitive rectifiers, with the gain switching being effected by the phase-shifted voltage at capacitor 123 of the phase shifting network.

The voltage provided by detection winding 5 is phase-shifted for the following reasons. If detection winding 5 were located in the immediate vicinity of heating ring 1, no phase shifting would be necessary as the signals at the outputs of amplifiers 92, 124 would be properly phased. In terms of space conditions, it is not feasible to locate detection winding 5 close to the heating ring 1. Because of the distance between heating ring 1 and detection winding 5, the two signals are not in phase any more. The phase shifting network acts to shift the phase of the detection winding 5 voltage to cause the two aforesaid signals to be in phase even where the detection winding is located on core 3 and is offset from heating ring 1. The phase shift due to the phase shifting network is determined and adjusted experimentally in dependence on the location of detection winding 5 relative to heating ring 1.

The output signals of amplifiers 96, 124' are supplied to comparator 10. More specifically, these output signals are applied for summation to one input of operational amplifier 101 in comparator 10. As the signal relating to the primary current and the signal relating to the voltage at the detection winding 5 are applied out of phase, the operation taking place actually is one of subtraction. Amplifiers 102, 103 in comparator 10 and the low-pass filter connected ahead of these amplifiers act to further amplify the difference between these two signals, as provided by amplifier 101, and to remove ripple components from the d.c. output. The signal present at the output of amplifier 103 is positive when current flows in the primary circuit and the actual temperature of heating ring 1 is lower than the desired or required temperature; the output signal of amplifier 103 is negative when current flows in the primary circuit and the actual temperature of heating ring 1 is higher than the desired or required temperature.

As has been stated above, the temperature of heating ring 1 can be measured only when current flows in the primary circuit. This current must flow in short intervals. To this end, an astable multivibrator having an exemplary ON period of one second and an exemplary OFF period of five seconds is provided; it comprises operational amplifiers 104, 105, for example, and it stops when potential is present at the output of amplifier 103. The output of the astable multivibrator or the output of amplifier 105 is coupled to the control electrode terminal of triac 8 in the primary circuit. When the output of amplifier 103 is positive, i.e. when the actual temperature of heating ring 1 is too low, triac 8 is triggered and conducts until measurement shows that the set temperature has been reached. Thereafter the basic OFF period is started. When the output of amplifier 103 is negative, i.e. when the actual temperature of heating ring 1 is too high, triac 8 is turned off after the basic ON period and the astable multivibrator re-triggers triac 8 after its OFF period has terminated to allow triac 8 to conduct for the one second ON period, after which it continues to conduct or is turned off according to the polarity of the output of amplifier 103.

In order to prevent current surges on turn-on, triac 8 should not be triggered in the zero transitions because a trigger voltage applied during a half-cycle causes lower starting currents. For this reason, the supply voltage is applied to one terminal of amplifier 105 through a phase shifting network 106, 107, 108, for example.

I claim:

1. A circuit arrangement adapted for connection to a source of electrical power for providing control of the temperature of a heating element adapted for contact by a material to be heated including:

an electronic switch;

a current sensing means;

a transformer having a core, a primary and a secondary winding, said primary winding having one end connected in series with said electronic switch and said current sensing means, said secondary winding providing the heating element, said current sensing means providing a signal representative of the current flowing in said primary winding;

a temperature detection means including a detection winding on said core;

voltage measuring means connected to said detection winding to provide a signal representative of the voltage generated by said detection winding;

a comparator connected to said voltage measuring means and said current sensing means for comparing said signal provided by said current sensing means with said signal provided by said voltage measuring means, said comparator having its output operatively connected to said electronic switch for providing control of said electronic switch dependent on the output of said comparator.

2. The circuit arrangement according to claim 1 wherein said electronic switch includes a triac.

3. The circuit arrangement according to claim 1 wherein said heating element is in the form of a metal ring placed on and mounted for rotation about a portion of said core of said transformer and adapted for contact by material in tape or strip form at the peripheral surface of said metal ring whereby the material is heated by said heating element.

4. The circuit arrangement according to claim 3 wherein said metal ring is aluminum.

5. The circuit arrangement according to claim 3 wherein said metal ring is supported for rotation.

6. The circuit arrangement according to claim 1 wherein a multivibrator circuit is provided for operatively connecting the output of said comparator to said electronic switch whereby said electronic switch conducts periodically for a basic ON period determined by said multivibrator circuit portion to cause current to flow through said primary winding during said basic ON period, the ON period being terminated in response to the output of said comparator assuming or exceeding a specific value, the basic ON period extended until the output of said comparator (10) has reached the specific value if the comparator output signal is below the specific value at the end of the basic ON period, said electonic switch terminating current flow through said primary winding periodically for basic OFF period following termination of the basic ON period or extended basic ON period.

7. The circuit arrangement according to claim 1 wherein said voltage measuring means includes an operational amplifier, the gain of which may be set to 1 or to −1 and which provides a signal representative of the voltage generated by said detection winding, said current sensing means includes an operational amplifier the gain of which is adapted to be set to 1 or to −1 and the output signal thereof representing the current flowing in the primary circuit, a phase shifting means included in said voltage measuring circuit, a circuit portion connected to said phase shifting means and said operational amplifiers to establish the gain of said operational amplifiers, said operational amplifiers acting a phase-selective rectifiers, and the phase shift provided by phase shifting means correcting for the phase shift due to the distance on said transformer core between said detection winding and said heating element.

* * * * *